United States Patent [19]

Larsen

[11] Patent Number: 4,802,664

[45] Date of Patent: Feb. 7, 1989

[54] ARRANGEMENT FOR THE FEEDING OF SHEETS TO A MAGAZINE

[75] Inventor: Arild Larsen, Rabbalshede, Norway

[73] Assignee: AB Tetra Pak, Lund, Sweden

[21] Appl. No.: 843

[22] Filed: Jan. 6, 1987

[30] Foreign Application Priority Data

Jan. 20, 1986 [SE] Sweden ..... 86002233

[51] Int. Cl.[4] ..... B65H 29/18

[52] U.S. Cl. ..... 271/201

[58] Field of Search ..... 271/200, 201, 300, 302, 271/296

[56] References Cited

U.S. PATENT DOCUMENTS

| | | | |
|---|---|---|---|
| 3,356,362 | 12/1967 | Mestre | 271/296 X |
| 3,682,473 | 8/1972 | Kuyt | 271/201 X |
| 3,957,264 | 5/1976 | Bach | 271/296 X |
| 4,068,837 | 1/1978 | Lamos | 271/296 |
| 4,315,621 | 2/1982 | Snellman | 271/296 |
| 4,322,069 | 3/1982 | Mitchell | 271/296 |
| 4,361,320 | 11/1982 | Kikuchi | 271/296 X |

FOREIGN PATENT DOCUMENTS

| | | |
|---|---|---|
| 3136113 | 5/1982 | Fed. Rep. of Germany . |
| 1515440 | 6/1978 | United Kingdom . |

*Primary Examiner*—Richard A. Schacher

*Attorney, Agent, or Firm*—Burns, Doane, Swecker & Mathis

[57] ABSTRACT

An apparatus for feeding out sheets to a stacking magazine wherein the sheets are fed out from a carriage which is lifted in timed relation with the growth of the stack of sheets so that the sheets are continuously fed out directly to the top end of the stack.

7 Claims, 2 Drawing Sheets

ARRANGEMENT FOR THE FEEDING OF SHEETS TO A MAGAZINE

FIELD OF THE INVENTION

The present invention relates to an arrangement for the feeding of sheets or blanks to a stacking magazine.

BACKGROUND OF THE INVENTION

Sheets or blanks of paper, plastics, packing laminate or other materials or material combinations are often used within a large number of different fields of application, e.g. in machines for the copying or transcription of texts as well as in machines for the manufacture of packages and the like. In such application a certain amount of handling of the sheets is unavoidable and it is customary, for example, for the sheets to be fed to or from magazines which are often in the form of stacking magazines where the sheets lie on top of one another in a vertical or inclined stack.

After sheets or blanks are cut from a coherent web, printed or handled in some other way, the sheets or blanks are fed one at a time to a stacking magazine. The feed-out of the sheets to the magazine can take place in various manners. In known packing machines the feed-out is done, for example, by one blank at a time being fed out substantially horizontally into the magazine, where, after it has been stopped by the front wall of the magazine, seen in the direction of feed, it tumbles down towards the bottom of the magazine and lands topmost in the stack present there. This type of feed-out is simple and the design is fairly inexpensive, but the arrangement has several disadvantages. Since the sheets are fed out and are allowed to drop down to the bottom of the magazine under their own weight and in a rather uncontrollable manner, it may happen that the sheets land obliquely or get stuck in a position which interferes with further feed-out. The rate of falling of the sheets in the free fall to the magazine bottom, moreover, is relatively low which hinders any relatively rapid feed-out of sheets to the magazine.

OBJECTS AND SUMMARY OF THE INVENTION

It is an object of the present invention to provide an arrangement for the feeding of sheets or blanks to a stacking magazine, this arrangement not being subject to the disadvantages of the aforementioned earlier arrangements, but making possible a safe and rapid feeding out of sheets to the magazine.

It is a further object of the present invention to provide an arrangement for the feeding of sheets or blanks to a stacking magazine, this arrangement handling the sheets in a gentle manner and placing them in a correct position into the magazine.

It is a further object of the present invention, moreover, to provide a feeding arrangement which is universably usable and is of a well-founded and simple design.

These and other objects have been achieved in accordance with the invention in that an arrangement of the type described in the introduction has been given the characteristic that it comprises a guide located next to the magazine, a carriage movable along the guide and driving belts for the driving of the carriage and for the transport and feed-out of sheets via the carriage to the magazine.

Preferred embodiments of the arrangement in accordance with the invention have been given, moreover, the characteristics which are evident from the enclosed subsidiary claims.

By designing the arrangement in accordance with the invention with a movable carriage which is lifted successively in timed relation with the feeding out of sheets into the magazine the blanks are no longer permitted to fall freely, which on the one hand ensures a safe handling, and on the other hand makes possible a higher rate of feed-out. Since the feeding out of each sheet to the magazine involves a simultaneous lifting of the carriage, the handling of the sheets will be gentle and the position of the carriage will be adapted automatically according to the height of the sheet stack.

BRIEF DESCRIPTION OF THE DRAWING

A preferred embodiment of the arrangement in accordance with the invention will now be described in more detail with special reference to the attached schematic drawings which only show the details indispensable for an understanding of the invention.

DETAILED DESCRIPTION OF A PREFERRED EMBODIMENT

Figure 1:
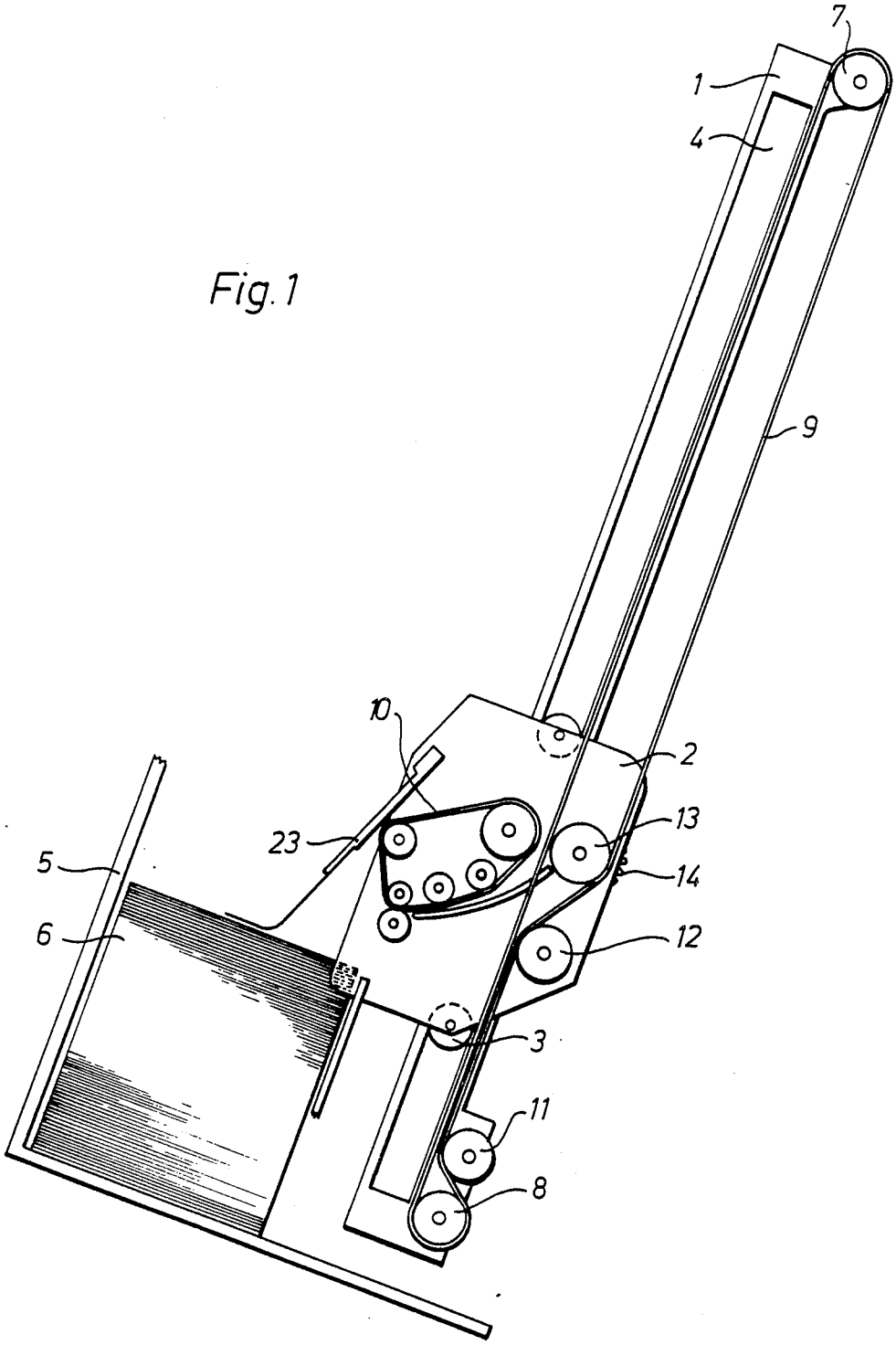
FIG. 1 is a side elevational view of an arrangement in accordance with the invention.

The arrangement in accordance with the invention can be seen from FIG. 1 and comprises a guide 1 which is firmly attached to a machine frame, not shown, and extends substantially vertically or slightly inclined, e.g. as in the preferred embodiment, at an angle of approx. 30° to the vertical plane. A carriage 2 is displaceable along the guide 1 and is controlled by a number of steering rollers 3 which are mounted so that they can freely rotate in the carriage 2 and roll in a track 4 in the guide. Close to the guide 1 there is a stacking magazine 5 which is designed so as to receive individual sheets or blanks 6 so that these form a stack which extends mainly parallel along the guide 1.

The guide 1 has on both its ends deflection pulleys 7,8, whereof the lower pulley 8 is supported so that it can freely rotate in the guide 1 whilst the upper pulley 7 is connected to an electric driving motor, not shown. Between the two deflection pulleys 7,8 extends an endless driving belt 9 which serves the double function of driving the carriage 2 along the guide 1 and of transferring sheets or blanks 6 from a feed-in position (not shown) located at the upper end of the guide 1 to the carriage 2. The sheets or blanks 6 subsequently are fed further to the stacking magazine 5 with the help, among other things, of a second belt 10 which in the following is called feed-out belt. Each one of the two belts 9, 10 can be designed as a relatively broad endless belt whose width substantially corresponds to the width of the sheet which is to be conveyed to the stacking magazine 5. However, it is also possible to substitute a relatively broad belt 9,10 by a number of narrower belts which may even be of circular cross-section. The belts appropriately are passed over joint, cylindrical rollers or over individual belt pulleys which are supported on common axles. In the continued description and claims, for the sake of clarity, the expression belt is used to describe the driving belt 9 as well as the feed-out belt 10, but it is understood that this concept also covers the case where the use of a greater number of relatively narrow belts is preferred instead. The active, sheet-transporting section of the driving belt 9 extends straight and freely from the upper deflection pulley 7 to the lower deflection pulley 8. The return section of the driving belt 9, which, as will be described in the following, is also used for driving the carriage 2 upwards along the guide 1, extends via a tension roller 11 supported in the guide 1 close to the lower deflection pulley 8, a tension roller 12 likewise supported so that it can freely rotate in the carriage 2 and a pulley 13 supported rotatably by the carriage 2 back to the upper driven deflection pulley 7. The two tension rollers 11,12, which in known manner may be spring-loaded so as to maintain the driving belt 9 stretched, steer the driving belt 9 in such a manner that it surrounds part of the pulley 13 and is kept in constant driving engagement with the same.

Figure 2:
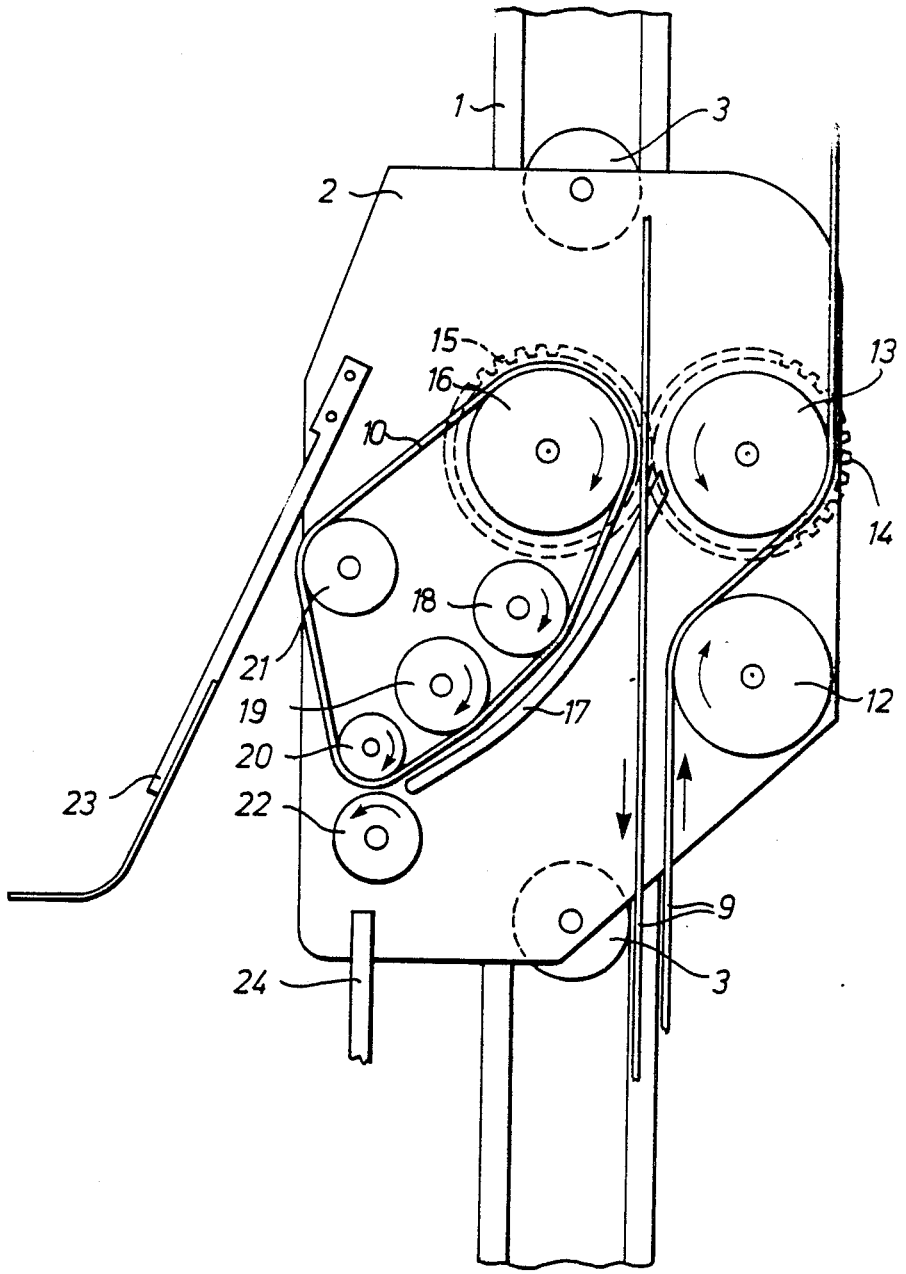
FIG. 2 is a side elevational view, on a larager scale, of the arrangement in accordance with FIG. 1.

As shown in FIG. 2, the pulley 13 is supported by an axle freely rotatable in the carriage 2 at whose other end is fixed a gear 14. The gear 14 cooperates, and is in constant engagement, with an identical gear 15 which is supported by an axle which is freely rotatable in the carriage 2 and on the opposite end of which is arranged a pulley 16. The pulley 16, which is of the same diameter as the pulley 13, is joined to, and drives, the feed-out belt 10 in such a direction that its active section, located adjoining the active section of the driving belt 9, moves rapidly downward in the direction of the magazine 5. Along the active section of the feed-out belt 10 extends a guide rail 17, which is curved and extends downward at a successively increasing angle toward the guide 1. At the upper end of the guide rail 17 there are two deflection pulleys 18,19 via which is passed the active section of the belt 10 to a pulley 20 serving as a deflection pulley. The feed-out belt 10 subsequently is guided mainly upward and via a belt tension pulley 21 which pulley is adjustable in conventional manner and back to the driving pulley 16.

Below the pulley 20 is located a feed-out roll 22. The feed-out belt 10 extends between the pulley 20 and the feed-out roll 22 whose centre axles are at such a distance from one another that the free distance between the belt and the feed-out roll in an unloaded condition of the arrangement is slightly less than the thickness of one of the sheets which are to be fed out. Preferably the distance amounts to between 0.3 and 0.8 times the sheet thickness and it has been found suitable in practical experiments for the distance to be 0.5 times the sheet thickness. The feed-out roll 22 is designed so that the distance between it and the belt 10 in the non-loaded condition increases against the effect of a predetermined force. This is achieved by making the pulley 20, the feed-out roll 22, or both, of a resilient material, e.g. rubber. It is also possible to achieve the desired resilience by providing the pulley or the feed-out roll 22 with movably supported centre axles, which are acted upon by means of suitable spring elements acting in a direction towards each other.

On the part of the carriage facing towards the stacking magazine 5 there is a supporting arm 23 extending obliquely downward, the front end of which consists of a flexible material, e.g. spring steel or a roll. The lower part of the carriage 2 moreover comprises a magazine wall 24 which is firmly attached to the carriage 2 and which forms a movable wall therewith in the stacking magazine 5, this wall being moved upward in timed relation with the carriage 2, and ensuring that the sheets 6 fed to the stacking magazine 5 always have an even surface to lie against.

During operation of the feeding arrangement in accordance with the invention, sheets 6 are fed in at the upper end of the guide 1 by means of a conventional feed-in arrangement, not shown. The sheets 6 are placed thereby one at a time onto the active section of the driving belt 9, that is to say the part of the driving belt 9 moving downwards which is facing towards the magazine 5. The driving belt 9 can be provided either with drivers fitted at regular intervals which support the sheet placed on the active section of the driving belt 9 and maintain it in position while it is transferred downward towards the carriage 2 with the help of the driving belt 9, or else a further endless belt, not shown, may be placed in front of the active section of the driving belt 9 so that the sheet fed in is retained between the two belts.

The active section of the driving belt 9 is advanced with the help of the driven deflection pulley 7 at a predetermined speed downward towards the lower deflection pulley 8, and the sheet placed on the driving belt 9 is carried along until its front end reaches the upper end of the guide rail 17 of the carriage 2. The guide rail 17 captures the sheet and removes it from the driving belt 9 in order to guide it instead between the guide rail 17 and the active section of the feed-out belt 10 which in the direction toward the stacking magazine 5 approaches the upper, somewhat curved gliding surface of the guide rail 17. The feed-out belt 10 is driven via the two gears 15, 14 and the pulley 13 by the rear, or upward moving, section of the driving belt 9 which with the help of the tension roller 12 is made to lie against, and drive, the pulley 13. With the help of the active section of the feed-out belt 10 the sheet is now fed along the top surface of the guide rail 17 until the front end of the sheet, seen in the direction of feed, gets in between the pulley 20 and the feed-out roll 22 and, owing to the limited free space between these, is pinched between the feed-out belt 10 and the surface of the feed-out roll 22. Since either the pulley 20, the feed-out roll 22, or both, are of a resilient design, the sheet as the resistance is increased, will be advanced further between the pulley 20 and the feed-out roll 22 and obliquely downward below the supporting arm 23 until it has been placed on the top in the stack of sheets in the magazine 5 and rests against the magazine wall 24. The increased resistance when the sheet passes between the pulley 20 and the feed-out roll 22 has the result that the movement of the feed-out belt 10 is counter-acted, so that the belt 10 becomes more sluggish and the pulley 16 is braked. The resistance is transmitted via the two gears 14,15 to the pulley 13 so that its rotation is braked and the upward moving section of the driving belt 9 lying against be periphery of the pulley 13, instead of simply rotating the pulley 13, via the pulley lifts the carriage 2 slightly upwards along the guide 1. In this process the pulley 13 and the gear 14 will be serving as a lever, whose one lever arm is constituted of the diameter between the point of action of the driving belt 9 on the periphery of the pulley 13 and the point of engagement of the gear 14 with the braked gear 15, and whose other arm is constituted of the radius between the common centre axle of the pulley 13 and the gear 14 and the point of engagement. As a result the carriage 2 will be lifted or advanced upward over a short distance at the same time as a sheet is fed out from the carriage to the magazine which means that the supporting arm 23 is lifted at the same time from its rest against the topmost sheet 6 in the stack of sheets and allows the introduction of the sheet fed out between the supporting arm and the stack of sheets. As soon as the rear edge, seen in the direction of feed, of the sheet fed out has left the space between the feed-out roll 22 and the pulley 20 the braking effect of the sheet upon the pulley 16 ceases and the driving belt 9 thus is no longer capable of lifting the carriage 2 but the latter slides downwards again a little way along the guide 1 until the bottom end of the supporting arm 23 once more rests against the stack of sheets.

Since the sheets are fed to the arrangement in accordance with the invention continuously and at regular intervals, the carriage 2 thus will be lifted over a short distance along the guide 1 in timed relation with the feeding out of sheets to the magazine 5 to be placed in position again thereafter with the supporting arm 23 resting against the topmost sheet in the magazine 5. Since each sheet during the whole time is actively fed from the feed-in position at the top end of the guide 1 to its ultimate position in the magazine 5, the handling is taking place very securely even if the feed-out rate is high, and the arrangement has proved in practical tests to function well at such high feed-out rates as 120 sheets per minute.

The arrangement in accordance with the invention for feeding out relatively narrow sheets may be of the design as shown in FIGS. 1 and 2, but it is also possible, for example for feeding out of relatively wide sheets, to design the arrangement with double, mirror-inverted guides and to provide the carriage with two identical, mirror inverted ends between which the different axles with their rotating elements are supported. The raising of the carriage 2 when a sheet is fed out between the pulley 20 and the feed-out roll 22 can be controlled in that the flexibility of the feed-out roll 22 or of the pulley 20 is varied so that the feed-out belt 10 and the pulley 16 with it are braked to a greater or lesser extent which means that a greater or lesser portion of the force of the driving belt 9 is used for the actual lifting of the carriage 2. Good results have been achieved in an arrangement where the pulley 20 as well as the feed-out roll 22 where supported so that they could rotate freely around axles which were adjustable but fixed in relation to one another, whilst the pulley 20 consisted of a resilient material and the feed-out roll 22 consisted of a flexible rubber material. The design and the position of these components can be varried of course and adapted to the type of sheet which is to be handled, the actual rate of feed and other requirements existing under the particular circumstances. While this invention has been illustrated and described in accordance with a preferred embodiment, it is recognized that variations and changes may be made and equivalents employed herein without departing from the invention as set forth in the claims.

What is claimed is:

1. An apparatus for feeding sheets or blanks to a stacking magazine comprising:

a guide located next to the magazine, a carriage movable along the guide, an endless driving belt extending along the guide, feed-out means for feeding-out sheets entering the carriage to the magazine, said feed-out means including an endless feed-out belt which is supported by the carriage and which includes an active section extending in a direction toward the magazine, said active section of the feed-out belt extending along a guide rail directed toward the magazine, said feed-out means further including a feedout pulley around which said feed-out belt is guided at a downstream end of said active section and a feed-out roll spaced from said feed-out belt by a distance, in a non-loaded condition, adapted to be less than the thickness of a sheet to be fed to the magazine, and drive means connected between the driving belt and the carriage for driving the carriage along the guide and for driving the feed-out means, the drive means including a first pulley which delivers drive to the feed-out means by rotating and which delivers drive to the carriage by frictionally engaging the driving belt.

2. An apparatus in accordance with claim 1, wherein the distance between the feed-out belt and the feed-out roll, in a loaded condition, increases against the effect of a predetermined force.

3. An apparatus in accordance with claim 1, wherein one of the feed-out pulley and the feed-out roll is made of a resilient material.

4. An apparatus in accordance with claim 1, wherein one of the feed-out pulley and the feed-out roll is spring-loaded in a direction toward the other.

5. An arrangement in accordance with claim 1, wherein the distance between the feed-out belt and the feed-out roll, in the non-loaded condition amounts to between 0.3 and 0.8 times the sheet thickness.

6. An apparatus for feeding sheets or blanks to a stacking magazine comprising:

a guide located next to the magazine, a carriage movable along the guide, an endless driving belt extending along the guide, feed-out means for feeding-out sheets entering the carriage to the magazine, said feed-out means including an endless feed-out belt which is supported by the carriage and which includes an active section extending in a direction toward the magazine, feed-out drive transmitting means for transmitting the rotational force of said first pulley to said feed-out belt, drive means connected between the driving belt and the carriage for driving the carriage along the guide and for driving the feed-out means, the drive means including a first pulley which delivers drive to the feed-out means by rotating and which delivers drive to the carriage by frictionally engaging the driving belt, and braking means for braking the movement of the feed-out drive transmitting means and for causing a braking of the rotation of said first pulley, the braking of the rotation of said first pulley causing the frictional engagement between said first pulley and said drive belt to increase so that said carriage is driven along said guide, said braking means being adapted to operate during the feeding of a sheet to the magazine.

7. An apparatus in accordance with claim 6, wherein said braking means includes a feed-out pulley around which said feed-out belt is guided at a downstream end of said active section and a feed-out roll spaced from said feed-out belt by a distance, in a non-loaded condition, adapted to be less than the thickness of a sheet to be fed to the magazine, a braking force being created in said feed-out belt during the passage of a sheet between said feed-out pulley and said feed-out roll so that the braking means operates only during the sheet passage.

* * * * *